United States Patent [19]

Morris et al.

[11] 4,453,202

[45] Jun. 5, 1984

[54] VANDAL-RESISTANT LIGHT FIXTURE

[75] Inventors: Earl L. Morris, La Habra Heights; Ron T. Hahn, Fullerton; Theodore J. Sally, Graton, all of Calif.

[73] Assignee: Acorn Engineering Company, City of Industry, Calif.

[21] Appl. No.: 455,750

[22] Filed: Jan. 5, 1983

[51] Int. Cl.[3] ..... F21S 1/02

[52] U.S. Cl. ..... 362/147; 362/223; 362/224; 362/225; 362/226; 362/235; 362/249; 362/251; 362/295; 362/297; 362/300; 362/301; 362/307; 362/310; 362/346; 362/351; 362/355; 362/360; 362/367; 362/368; 362/374; 362/375; 362/376

[58] Field of Search ..... 362/147, 223, 224, 225, 362/226, 235, 249, 251, 297, 295, 300, 301, 307, 310, 346, 351, 355, 360, 367, 368, 374, 375, 376

[56] References Cited

U.S. PATENT DOCUMENTS 2,330,935 10/1943 Tuck .

3,340,393 9/1967 Franck et al. ..... 362/375

*Primary Examiner*—Stephen J. Lechert, Jr.

*Attorney, Agent, or Firm*—Edgar W. Averill, Jr.

[57] ABSTRACT

A vandal resistant security light fixture having a housing and a light which is serviceable and removable from outside the room in which it is installed. The housing has at least one surface which faces into the room and is open at the back to permit servicing or replacement of the light assembly without having to enter the room. The fixture is vandal resistant and is particularly useful in prison cells and may be provided with one or more vandal resistant switches and vandal resistant electrical receptacles.

17 Claims, 5 Drawing Figures

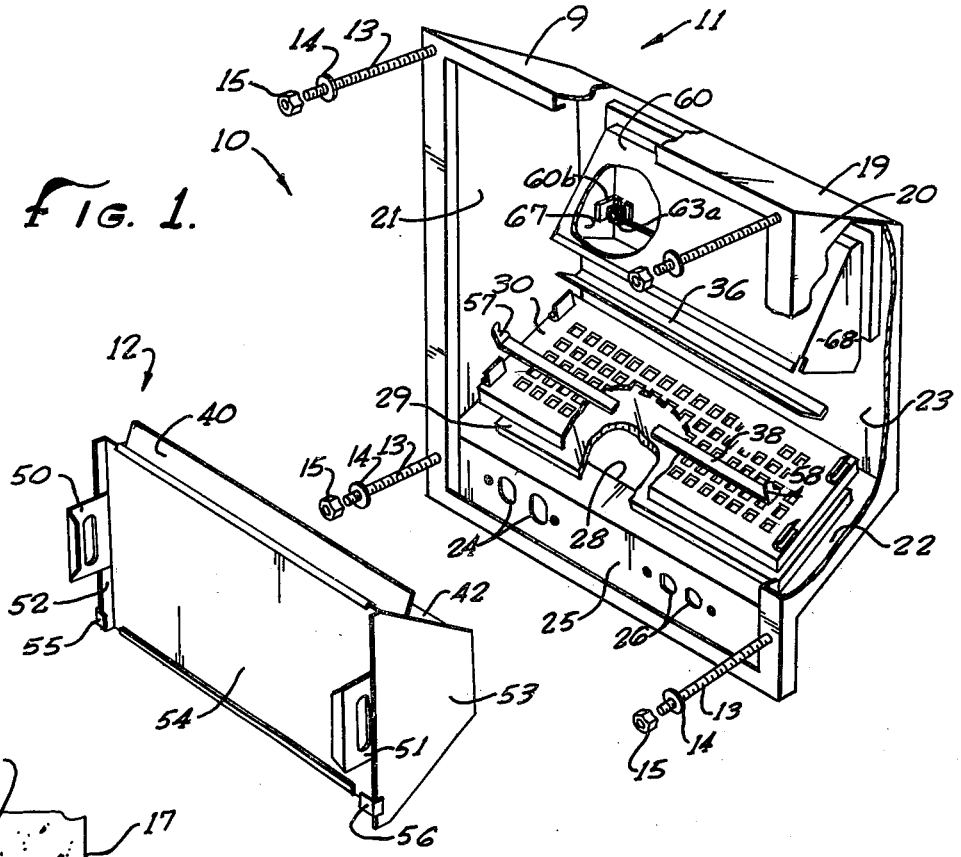
FIG. 1.
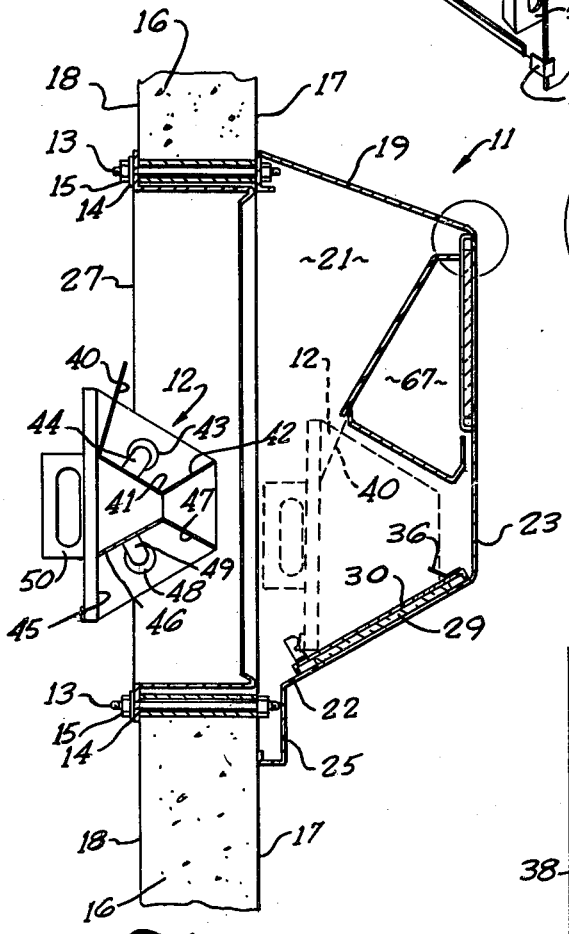
FIG 2.
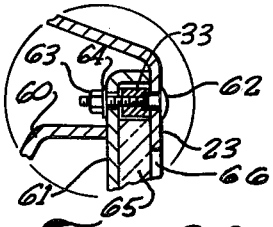
FIG. 2A.
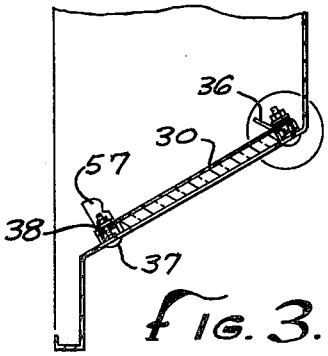
FIG. 3.
FIG. 3A.
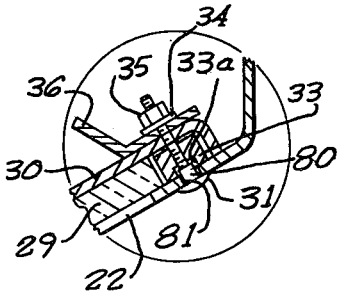

VANDAL-RESISTANT LIGHT FIXTURE

CROSS REFERENCE TO RELATED APPLICATIONS

This application is being filed the same day as the following applications which are assigned to the assignee of the present application: Ser. No. 455,746, Wall Sleeve and Installation Jig for Multiple Adjacent Fixture Mounting; Ser. No. 455,753, Vandal Resistant Push Button Electrical Switch Assembly; Ser. No. 455,752 Vandal Resistant and Tamper-Proof Plenum or Vacuum Chamber Security Air Flow Adjustment Device; Ser. No. 455,751 Plenum/Vacuum Chamber with Duct Connection for Installation in Cabinet Fixtures to Control Air Supply or Return; Ser. No. 455,668 Security Mirror Replaceable from Pipe Chase and Ser. No. 455,665 Vandal Resistant and Tamper-Proof Multi-Purpose Modular Lavatory/Toilet.

BACKGROUND OF THE DISCLOSURE

The field of the invention is lighting fixtures and the invention relates more specifically to lighting fixtures which are useful in prision cell and other institutions and applications where vandal resistance is very important.

In the past, maximum security lighting has been provided merely by covering a conventional flourescent or incandescent lighting source with an impact resistant diffuser made from a material such as an injection molded polycarbonate. Such fixtures were typically either installed in a housing attached with vandal resistant screws and placed on the ceiling or at the corner of the ceiling and a wall of the room or cell and when the light bulb burned out or the fixture otherwise needed servicing, it had to be serviced from within the cell. With such prior art light fixtures, destruction by inmates is possible. Furthermore, inmates can remove the screws and have access to the interior of the light assembly which can even provide a means for inmates to commit suicide. There is thus a need for a more secure lighting assembly than is presently available.

The steps required to provide maintenance service in a prison cell are labor intensive. First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from the prisoners. Therefore, even for a simple maintenance task, it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell. Furthermore, the prior art diffusers even though resistant to impact were not completely immune thereto and such fixtures were frequently destroyed by vandalism.

The American Correctional Association has established standards for adult correctional institutions and the present standard relating to lighting is contained in Sections 2-4130 through 2-4135 in the second edition published Jan. 19, 1981. This standard requires that a lighting source be provided at least twenty foot candles in intensity at desk level and in the personal grooming area. In many installations, a night light is also utilized and in the past this too has been the object of vandalism.

SUMMARY OF THE INVENTION

It is thus an object of the present invention to provide a lighting fixture which provides an appropriate amount of lighting in conformance with the code requirements while at the same time being totally immune to vandalism in the cell area which is serviceable and removable from outside the cell or room in which it is installed.

The present invention is for a vandal-resistant security light and housing assembly which is serviceable from outside the room in which it is installed. The fixture has a housing mountable over an opening in the wall of a room or cell. The housing is open in the back and the interior thereof is accessible from the back side of the wall in which it is mounted. The housing has a vandal-proof light transmitting area and a reflector and bulb assembly is mounted in the fixture adjacent to at least one of the light transmitting areas. The reflector and bulb assembly has means for detachment from the back side of the housing and the reflector and bulb assembly are inaccessible from the room side of the housing. Preferably, the fixture is fabricated from heavy gauge steel and the light transmitting area is formed from one or more openings formed through a housing wall none of which are more than five inches wide. A five inch wide opening is considered escape proof by prison officials. Preferably, the openings are covered by a transparent lens means. The same fixture may have two or more transparent areas so that both night lighting and brighter lighting for a desk or grooming area may be provided from the same fixture. One or more vandal-proof switches are preferably provided on the front of the housing and electrical receptacles may also be mounted in the housing.

BRIEF DESCRIPTION OF THE DRAWINGS

FIG. 1 is a perspective view of the fixture of the present invention.

FIG. 2 is a side view showing an installed reflector assembly in phantom view of the fixture of FIG. 1.

FIG. 2*a* is an enlarged view of the circled portion of FIG. 2.

FIG. 3 is a fragmentary view showing the lens assembly of the fixture of FIG. 1.

FIG. 3*a* is an enlarged view of a portion of the lens assembly and mounting flange shown in FIG. 3.

DESCRIPTION OF THE PREFERRED EMBODIMENTS

Figure 4:
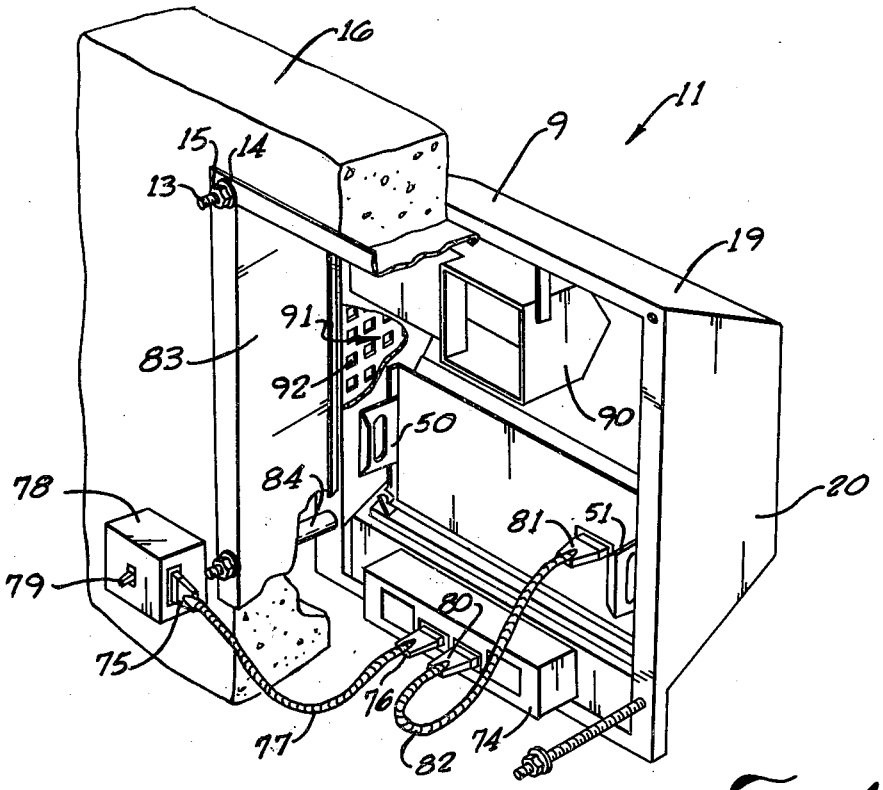
FIG. 4 is a perspective view partly broken away of the fixture of FIG. 1 installed in a wall.

The vandal-resistant security light and housing assembly is shown in perspective view in FIG. 1 and indicated generally by reference character 10. Fixture 11 has a housing 9 which is installed securely in an opening in the wall of a prison cell or other room as shown best in FIG. 4. The reflector assembly 12 is removably mounted in housing 9. As shown in FIG. 4, housing 9 is preferably bolted to a sleeve 83 which is securely embedded in the cell wall 16 and the fixture is held to the sleeve and thus to the wall by studs 13 onto which a washer 14 and nut 15 are secured. A portion of the wall 16 is shown in FIG. 2 and the cell side of the wall is indicated by reference character 17 and the chase side of the wall is indicated by reference character 18. A corridor containing plumbing fixtures, piping, electrical conduit and the like is always located along one wall of a prison cell, and this corridor is referred to as a pipe chase. The chase is accessible to maintenance personnel without the necessity of entering the cell. As pointed out above, it is highly desirable that maintenance and service work be done from the chase to avoid labor intensive and disruptive steps required for maintenance personnel to enter the cell.

Housing 9 is preferably fabricated from steel such as stainless steel and has a top 19, sides 20 and 21 a bottom 22 and a front 23. Top 19 is sloped toward the front at an angle of at least about 20 degrees. This has two important advantages. First, it prevents the prisoner from storing objects on the top since they will roll off. Secondly, it permits the guard to view the top surface without having to climb up to do so. Thus, the guard can easily view contraband placed on the top. Openings 24 for electrical receptacles are formed in extension 25 of bottom 22. Similarly, switch openings 26 are formed in extension 25.

Figure 5:
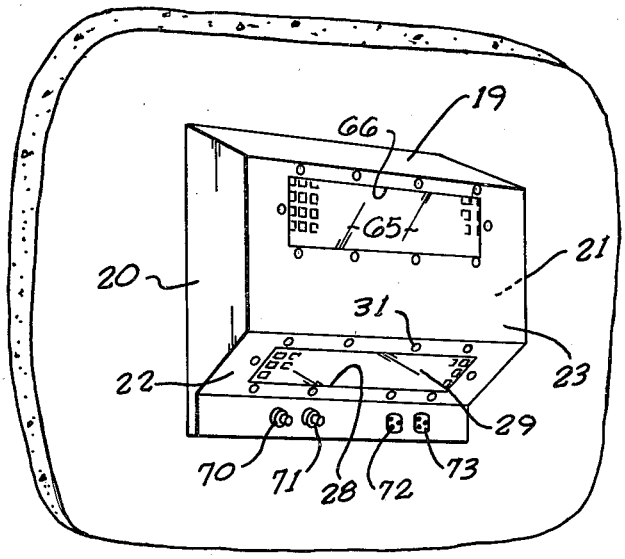
FIG. 5 is a perspective view showing the front side of the fixture of FIG. 1.

As shown in FIG. 5, switches 70 and 71 are mounted in openings 26 and are vandal resistant switches which may be operated from within the cell but are serviceable from the pipe chase. Similarly, electrical receptacles 72 and 73 are available from within the cell and serviceable from the pipe chase. The switches and outlets are housed in box 74. Electricity is supplied to the fixture by a plug-in cable set having plugs 75 inserted in an appropriate connector in junction box 78 affixed to the wall. Plug 76 is inserted in a connector housed in box 74. In order to assure correct electrical polarity, plug 75 fits only in box 78 and not in the connector in box 74. A switch 79 provides a convenient method for disabling the unit turning off both the light and the electrical outlets. This facilitates servicing the unit and also provides a convenience during installation since the power can be easily turned off until installation is complete.

The electrical supply to the light is provided by a second identical removable cable set consisting of plugs 80 and 81 and flexible cable 82. The plugs are all, of course, removable and thus the entire reflector assembly 12 may be readily and quickly removed and replaced. If the lighting fixture malfunctions for any reason, a maintenance man merely brings a replacement unit into the pipe chase, turns off switch 79, removes plug 81, grasps handles 50 and 51 and removes the light and reflector assembly 12. The replacement assembly is then held by its handles and inserted in place and plug 81 is inserted into the socket in the replacement unit. Alternatively, if only the bulb or bulbs need replacing, the unit can be removed as above, the bulbs replaced and the unit snapped back in place. Instead of the labor intensive set of steps required by prior art light fixtures, only the maintenance man is needed since he may enter the pipe chase without any exposure to the prisoners. Similarly, if service on the switch is required, this can be accomplished by extracting plugs 76 and 80 and removing box 74. This also does not require entering the cell.

The installation of fixture 11 in wall 16 is shown clearly in FIG. 4. A wall sleeve 83 forms an opening in poured concrete wall 16. Four hollow cylinders 84 are imbedded in wall 16 and provide passageways for the studs 13. The studs 13 are threaded into nuts welded in housing 9 and secured to the wall by nuts 15 and washers 14.

A rectangular opening 28 is formed in bottom 22 and provides a region for light transmission. A lens member 29 is held above opening 28 by a grate 30 which is bolted from the interior of the housing to bottom 22 in a manner shown best in FIGS. 3 and 3*a*. In FIG. 3*a*, bolt 31 is a carriage bolt and has a squared portion 80 which fits a square hole 81 to prevent turning and removing bolt 31 from the cell. A spacer unit 33 has a recessed area 33*a* which fits over squared portion 80. Nut 33 is fabricated so that it provides a stop for grate 30. By making nut 33 slightly smaller than the space between the housing and the grate, over tightening of the grate against lens 29 is prevented. This protects lens 29 from breaking as a result of careless installation. The amount of free space between the lens abutting surface of grate 30 and the end of spacer nut 33 before tightening is about 1/16th of an inch. The presence of spacer nut 33 also prevents a dimpling of the surface of the fixture by unrestricted over tightening of nut 35. Such dimpling could possibly further lead to a raising up of the edge of the opening away from the lens surface. The presence of the spacer nut avoids such possibility.

Lens opening 28 is preferably five inches or less in width so that even if the lens and the grate are removed, the opening is still escape proof. Furthermore, by holding the bolts 31 against the housing by nuts 33 removal and replacement of either or both of the lens or grate from the pipe chase is facilitated. Nuts 35 and washers 34 are simply removed from the chase and replacement made.

Nut 35 also holds flange 36 which serves to support the reflector assembly 12 in a manner described in further detail below. A similar nut and bolt assembly indicated generally by reference character 37 holds the grate 30 as well as the bracket 38 which also helps support the reflector assembly 12.

Reflector assembly 12 is shown is cross-sectional view in FIG. 2. There it can been seen that the assembly has two separate reflectors, the upper one consisting of reflector surfaces 40, 41 and 42 with the bulb 43 being held in a socket 44. Similarly, a second reflector assembly has reflector surfaces 45, 46 and 47 with a bulb 48 being held in socket 49. A pair of handles 50 and 51 are welded to sides 52 and 53. A back 54 provides a mounting plate for the ballast held within.

Reflector plate 47 is placed under flange 36 and a pair of ears 55 and 56 are then downwardly inserted into the ends 57 and 58 of bracket 38. The reflector shield 60 is bolted against the back of grate 61 by nut 63*a* holding brace 60*b* and a similar brace holds the opposite side of reflector shield 60. This detail is shown in FIG. 1. In FIG. 2*a*, grate 61 is shown held to front 23 by bolt 62, nut 63 and washer 64. Grate 61 holds lens 65 in place against the opening 66 in front 23. Shield 60 has two sides 67 and 68 which help direct the light out of opening 66. As can be seen in the phantom lines in FIG. 2, reflector surface 40 abuts against shield top 60 to enclose the bulb 43 so that its light is directed almost entirely out of opening 66.

The lens and grate combination used in the light fixture assembly of the present invention is a particularly vandal proof combination. The lens may be formed from glass or from a laminate of a transparent plastic such as an acrylic or a polycarbonate and glass. Since a grate is held tightly against the back of the lens, it is further protected from breakage and even in the unlikely event that the lens is broken, the grate still prevents any further damage to the interior of the fixture. The lens and grate combination, of course, also almost completely eliminates any chance of electrical shock since it prevents contact with the bulb or any part of the reflector assembly. Furthermore, the lens surface may be easily cleaned by the inmate from within the cell.

The fixture of the present invention may be installed above a writing area and readily is capable of providing the 20 foot candles at desk level which is called for in the standards for adult correctional institutions referred to above. Furthermore, bulbs of lower intensity can be placed in a different socket of the fixture to provide a night light or other required source of illumination.

The fixture, reflector and bulb assembly shown in the drawing has two reflector surfaces which are directed about 120 degrees from each other. This permits a single fixture to serve readily as a desk light as well as a room light. Advantageously, the bulb mounting surfaces are directed between 90 and 180 degrees with respect to one another.

By assembling a light and reflector assembly further contaning a ballast in the factory, the quality control available in the factory can be utilized. Thus the necessity of relying on remote installation personnel for wiring can be eliminated and factory control of quality is assured.

While the above invention has been described in relation to a reflector assembly having two bulbs, it is, of course, within the scope of the present invention that the assembly have a single bulb or more than two bulbs. Furthermore, while the reflector assembly is shown as being mounted on the bottom of the fixture, it could alternatively be mounted on the front surface. Furthermore, the grate may be formed in the surface of the fixture rather than an as a separate grate on the back of the lens. In that way, the lens would be held on the back of the grate.

Another advantage of providing a housing which protrudes into a cell is the ability to add air ventilation means to the unit. As shown in FIG. 4, air ducting 90 is affixed to a plenum or vacuum chamber 91. Openings 92 in side 21 of housing 9 provide the necessary air flow passageway for ventilation.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A vandal-resistant security light and housing assembly which is serviceable from outside the room in which it is installed comprising:

a metal housing mounted over an opening in the wall of the room and extending into the room, said wall having an interior surface which faces the room and an exterior surface, said housing having an upwardly facing surface and a downwardly facing surface, said housing being open in the back and the interior thereof being accessible from the back side of the wall on which it is mounted, said housing having a light transmitting area comprising at least one opening formed therethrough and lens means covering said at least one opening, said light transmitting area being located in at least the downwardly facing surface of said housing; and a reflector, florescent bulb and ballast assembly mounted in said housing adjacent at least one of said light transmitting areas, said reflector florescent bulb and ballast assembly being positioned so that it does not protrude past said exterior surface of said wall and having a socket affixed thereto, said socket having a detachable plug inserted therein, said reflctor, florescent bulb and ballast assembly having quick disconnect means for detachment from the backside of said housing and said reflector and bulb assembly being inaccessible from the room side of the fixture; and

2. The light and housing assembly of claim 1 wherein said reflector and bulb assembly further contains handle means accessible from the back surface of said assembly whereby removal of said reflector and bulb assembly is facilitated.

3. The light and housing assembly of claim 1 further including vandal resistant switch means affixed to said housing and electrically connected to the reflector and bulb assembly.

4. The light and housing assembly of claim 1 further including at least one electrical receptacle affixed to said housing.

5. The light and housing assembly of claim 1 wherein said light transmitting area further includes grate means affixed to the housing and held against the back surface of the lens means by fastening means.

6. The light and housing assembly of claim 5 wherein said lens means is positioned over said opening by said fastening means.

7. The light and housing assembly of claim 6 wherein said fastening means comprises carriage bolts held to the housing by first nut means and wherein the grate means is held to the housing by said carriage bolts and a second set of nut means.

8. The light and housing assembly of claim 7 wherein said first nut means are of a thickness so that the side of the grate means adjacent to the lens means abuts said first nut means to prevent over tightening of the grate means against the lens means.

9. The light and housing assembly of claim 7 wherein the metal grate has a plurality of square openings therethrough and is positioned between the transparent lens and the reflector and bulb assembly.

10. The light and housing assembly of claim 1 wherein there are a plurality of light transmitting areas.

11. The light and housing assembly of claim 10 wherein said housing has two light transmitting areas formed therethrough and said reflector and bulb assembly has two separate reflecting surfaces.

12. The light and housing assembly of claim 11 wherein both of said light transmitting areas has transparent lens means affixed to the inside thereof.

13. The light and housing assembly of claim 12 wherein said reflector and bulb assembly has two sets of reflectors aimed between 29 degrees and 180 degrees with respect to each other and the housing has light transmitting areas in two different surfaces of said housing.

14. The light and housing assembly of claim 1 wherein said means for detachment comprises a longitudinal flange affixed along one edge of one of said light transmitting areas and snap means affixed along the edge opposite the flange.

15. The light and housing assembly of claim 1 further including vandal-resistant switch means affixed to said housing.

16. The light and housing assembly of claim 1 further including air duct means affixed to a plenum/vacuum chamber affixed over openings formed through a wall of said housing.

17. The light and housing assembly of claim 1 wherein said housing has a flat top surface which surface is sloped at an angle of at least about 20 degrees with respect to the horizontal whereby the ability to store articles on the top surface is substantially impaired.

* * * * *